US006521869B1

(12) United States Patent
Donnelly et al.

(10) Patent No.: US 6,521,869 B1
(45) Date of Patent: Feb. 18, 2003

(54) SYSTEM FOR POWERING AN IGNITER TO A LEVEL PROVEN TO IGNITE GAS

(75) Inventors: Don E. Donnelly, Fenton, MO (US); Jeffrey N. Arensmeier, St. Louis, MO (US); Steve E. Coats, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/971,200

(22) Filed: Oct. 4, 2001

(51) Int. Cl.[7] ..... F23N 5/00
(52) U.S. Cl. ..... 219/263; 219/497; 431/66
(58) Field of Search ..... 219/263, 270, 219/497; 431/66, 258; 361/264–266

(56) References Cited

U.S. PATENT DOCUMENTS 4,444,551 A 4/1984 Mueller et al.
4,518,345 A 5/1985 Mueller et al.
4,925,386 A 5/1990 Donnelly et al.
5,725,368 A 3/1998 Arensmeier
5,951,276 A * 9/1999 Jaeschke et al. ..... 431/66
6,474,979 B1 * 11/2002 Rippelmeyer ..... 431/67

* cited by examiner

*Primary Examiner*—John A. Jeffery
(74) *Attorney, Agent, or Firm*—Kevin Pumm

(57) ABSTRACT

A microprocessor-controlled triac switching circuit for an igniter, having line voltage and igniter current input signals to a microprocessor for determining power to the igniter. Upon determining the line voltage, the microprocessor selects from a look-up table a corresponding triac-switching sequence intended to drive the igniter to a power level proven to ignite gas. The igniter current resulting from the switching sequence is fed to the microprocessor, which determines the actual power and an offset value. The offset enables adjustment by shifting sequences, to achieve the pose level at which the igniter is proven to ignite gas.

11 Claims, 3 Drawing Sheets

SYSTEM FOR POWERING AN IGNITER TO A LEVEL PROVEN TO IGNITE GAS

FIELD OF THE INVENTION

This invention relates to systems for controlling the energizing of electrical resistance igniters for proven ignition systems.

BACKGROUND OF THE INVENTION

In many gas-fired devices, standing pilots have been replaced by either hot surface igniters or spark ignition devices. While spark ignition devices provide rapid ignition, they generate undesirable electrical and acoustical noise. In applications that use a microprocessor, such electrical noise is undesirable since it can adversely affect operation of the microprocessor. In addition, spark devices may be difficult to predict as to generation of an arc proven to ignite gas. Hot surface ignition does not generate such electrical or acoustical noise, but does require careful control of its temperature to prevent damage to the igniter.

An igniter known in the art that is capable of warming up quickly is a silicon nitride igniter, an igniter constructed of a tungsten alloy heater element embedded in a silicon nitride insulating material. While such an igniter is desirable because of its mechanical strength and durability, it has a critical temperature limitation, which must be adhered to. Specifically, the silicon nitride igniter must remain below approximately 1300° C. If the igniter temperature repeatedly approaches 1300° C., the igniter will prematurely fail, such failure generally consisting of the opening of the tungsten heater element. Since a temperature over 1100° C. is required to reliably ignite gas, the igniter must operate within a narrow temperature span between the lowest temperature that will reliably ignite gas and the highest temperature that the igniter can withstand.

U.S. Pat. No. 4,925,386, assigned to the assignee of the present invention, discloses a learning routine for energizing an igniter to a temperature above the minimum ignition temperature, and successively energizing the igniter to a slightly lower temperature during each successive cycle until it fails to ignite the gas. After an unsuccessful ignition attempt, energy to the igniter is increased so that the igniter operates just above the lowest possible ignition temperature, which prolongs igniter life. While an occasional unsuccessful ignition attempt is generally acceptable in many applications, it is not acceptable in commercial applications of high BTU output that require a proven method for igniting gas.

U.S. Pat. No. 5,725,368, assigned to the assignee of the present invention, discloses a system for determining the level of power to be applied to the igniter based on the value of the voltage available to energize the igniter and on the value of the resistance of the igniter. A triac in series with the igniter is fired in an irregular firing sequence, which is determined from a look-up table in a microcomputer. Specifically, the look-up table enables selecting a firing sequence based on the determined value of line voltage and the determined "cold" resistance value of the igniter. But due to manufacturing tolerances, the "cold" resistance of the igniters can vary considerably from igniter to igniter. In addition, the "cold" resistance of each igniter can vary considerably from cycle to cycle as a result of residual heat in the igniter. Such variances are difficult to accurately compensate for. While prior art systems are useful for the purposes described, there is still a need for a method of accurately controlling the power and temperature of an igniter that is used where a proven source of igniting gas is required before the gas supply is opened.

SUMMARY OF THE INVENTION

The present invention relates to a microprocessor-controlled triac-switching circuit for a silicon nitride igniter, having line voltage and igniter current input means to the microprocessor for determining power to the igniter. Upon determining the line voltage, the microprocessor uses a look-up table to select a corresponding triac-switching sequence to drive a igniter to a power level proven to ignite gas via empirical testing on the application. The igniter current resulting from the switching sequence is fed to the microprocessor, which determines the actual power level and an offset value. The offset functions as a compensation means, shifting the sequences in the look-up table to achieve the desired power to the igniter. After a predetermined warm-up time, the microprocessor sends a signal indicating whether the igniter is at a power level proven to ignite gas.

DETAILED DESCRIPTION OF THE PREFERRED EMBODIMENTS

Figure 1:
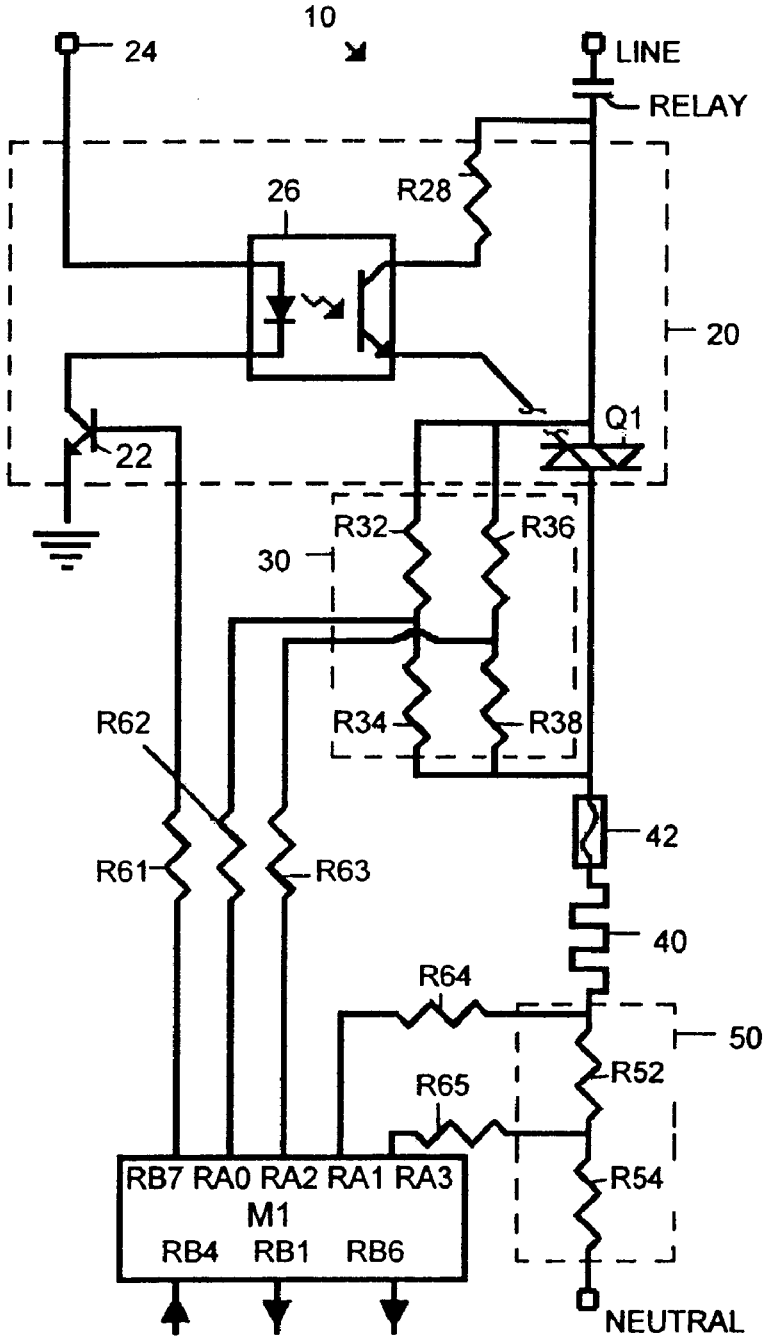
FIG. 1 is a schematic diagram of an igniter controlling system in accordance with the present invention.

The igniter controlling system in accordance with the present invention is indicated generally at 10 in FIG. 1. Igniter controlling system 10 includes a microprocessor M1 for controlling a triac switching circuit 20 for providing power to an igniter 40, a voltage measuring means 30 for determining the value of line voltage, and a current measuring means 50 for determining the current through the igniter 40. The igniter controlling system 10 may be incorporated into an integrated furnace control or integrated boiler control that controls a supply of gas to a burner in a gas furnace or boiler. However, the igniter controlling system of the present invention is not so limited, and can be incorporated into devices for controlling ignition in other gas applications.

The traic switching circuit shown generally at 20 essentially comprises a transistor 22 that switches power from supply 24 to the input of an opto-isolator 26, which gaits a triac Q1 for switching power to the igniter 40. The power supply 24 of the present invention is a 24 volt dc supply with a dropping resistor to reduce the voltage to the opto-isolator 26, but may optionally be a 5 volt dc supply or other equivalent supply means. Opto-isolator 26 switches 120 VAC (line voltage) across a dropping resistor to supply a gait current to traic Q1. The opto-isolator 26 preferably is of a type that switches at the zero crossing of the AC voltage source, so as to gait the traic Q1 and switch power to the igniter when the voltage level is lowest to minimize electrical noise. An equivalent circuit that will switch the triac Q1 at approximately the zero crossing of the AC voltage source may optionally be substituted for the opto-isolator 26 above.

The voltage measurement means shown generally at 30 comprises a redundant set of resistor branches in parallel with the triac Q1. The branches have a resistance value significantly higher than that of the igniter 40, such that when the triac Q1 is open the line voltage is effectively dropped across the resistor branches. The branches are comprised of two resistors R32 and R34 in series, and two resistors R36 and R38 in series. Resistors R32, R34, R36 and R38 are all of equal resistance. Voltage is taken at a point between the resistors R32 and R34, and at a point between R36 and R38, for input to the microprocessor M1 for determining the value of the line voltage.

The igniter 40 preferably is a Kyocera WRS-6 Silicon Nitride igniter, and is effective, when sufficiently heated, to ignite gas. Silicon Nitride igniter 40 has a resistance range of 12 to 60 ohms depending on temperature, and must remain below approximately 1300° C. to prevent premature failure of the igniter. Igniter 40 is also in series with a fuse 42 to protect against shorting of the igniter.

The igniter current measurement means shown generally at 50 comprises a set of current sampling resisters R52 and R54 in series with the igniter 40. Voltage is taken on the high side of the resistors R52 and R54, for input to the microprocessor M1 for determining the current through the igniter 40.

A microprocessor M1 is effective for controlling operation of igniter controlling system 10. Preferably, microprocessor M1 is a Microchip PIC16 F87 X device. Included within microprocessor M1 are a CPU, a ROM (read only memory), a RAM (random access read/write memory), and a plurality of I/O (input output) pins. Such I/O pins include pins RA0, RA1, RA2, RA3, RB1, RB4, RB6, and RB7. Microprocessor M1 controls the switching of triac Q1 via transistor 22 through input impedance resistor R61 and pin RB7. Line voltage measurements are input to the microprocessor M1 through input impedance resistors R62 and R63 and pins RA0 and RA2 respectively. Igniter current sampling measurements are input to the microprocessor through input impedance resistors R64 and R65 and pins RA1 and RA3 respectively.

It is to be understood that microprocessor M1 has a plurality of other pins (not shown) that are connected to other circuitry not shown in FIG. 1. However, a description of such other pins and other circuitry is not believed to be essential to provide an enabling disclosure of the present invention and is therefore omitted.

Figure 2:
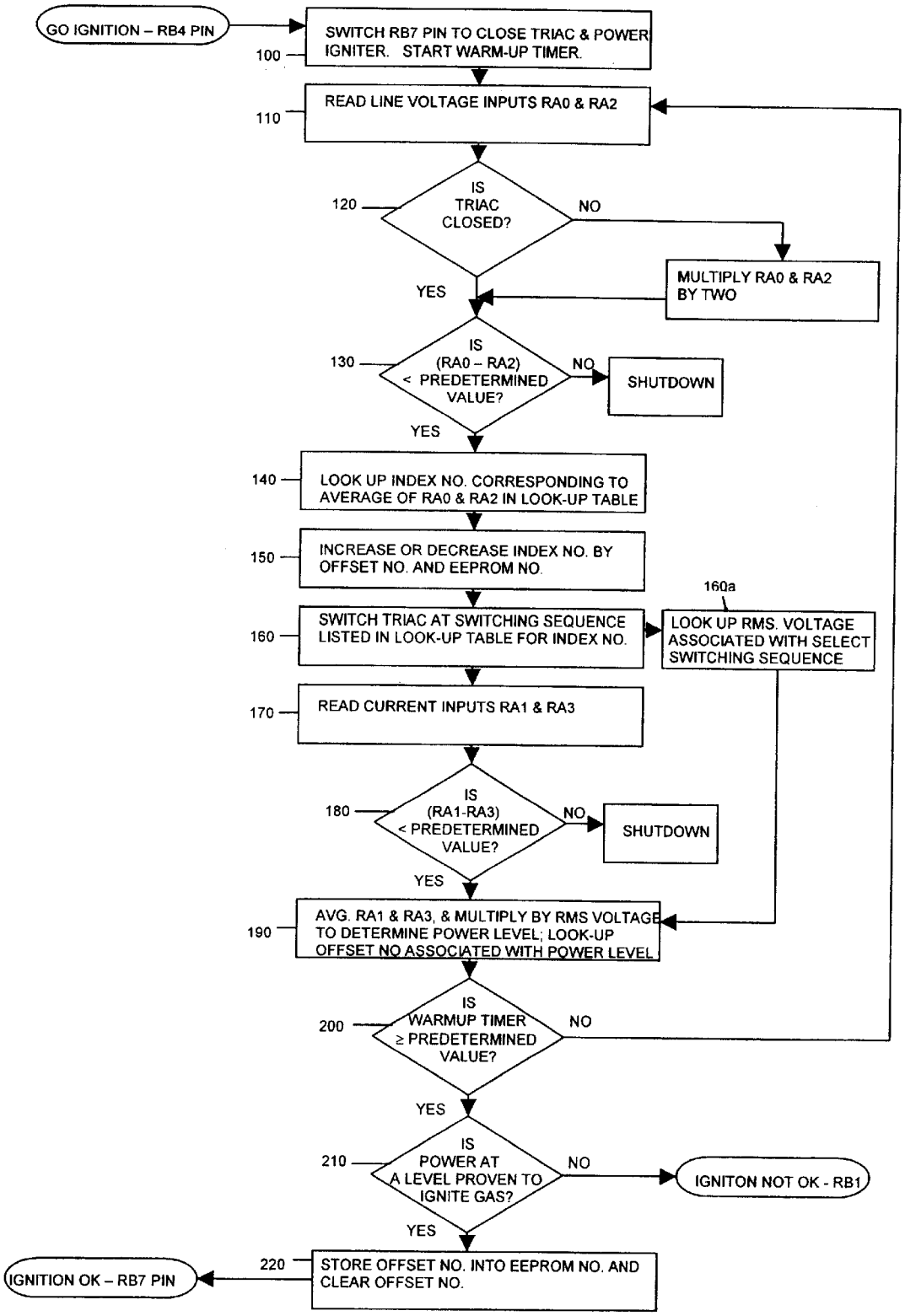
FIG. 2 is a flowchart outlining an igniter controlling system in accordance with the present invention for use in the ignition controlling system of FIG. 1.

In operation as shown in FIG. 2 step 100, microprocessor M1 switches triac Q1 through pin RB7 to provide power to the igniter 40, and starts a warm-up timer. The traic Q1 when closed has a voltage drop of approximately 1.7 volts, as do the resister branches in parallel with triac Q1. Thus, at step 110 when the microprocessor M1 reads line voltage inputs, it essentially reads line voltage less 0.85 volts across resistors R32 and R36. If the redundant line voltage inputs at step 130 do not differ more than a predetermined amount, the microprocessor M1 proceeds in step 140 to look up an index number corresponding to the averaged line voltage inputs in a look-up table. Microprocessor M1 then increases or decreases the index number by an offset number and an EEPROM number in step 150. These numbers function as compensation means to adjust power to the igniter 40, and initially have no value. At step 160, the microprocessor M1 selects a switching sequence in the look-up table corresponding to the index number, and initiates the switching sequence. The look-up table essentially comprises a plurality of switching sequences, or on and off times corresponding to known line voltage values. The amount of on-time verses off-time increases as the line voltage level decreases, to increase the on-time for applying voltage to the igniter 40. The microprocessor M1 determines the RMS voltage to igniter 40 based on the line voltage value and the on-off duty ratio of the select switching sequence. Upon determining the RMS voltage to the igniter 40 in step 160*a*, the microprocessor M1 reads igniter current inputs through pins RA1 and RA3 in step 170. Due to the resistance variations of production igniters, the measured current may vary from igniter to igniter, as may the power. If the current inputs at step 180 do not differ more than a predetermined amount, the microprocessor M1 determines the product of the RMS voltage and average current to obtain the actual power to the igniter. Upon obtaining the actual power level at step 190, the microprocessor M1 proceeds in step 200 to look up an offset number corresponding to the actual power level in the look-up table. The offset number is used to shift switching sequences within the look-up table to change the on verses off time and adjust the RMS voltage to the igniter 40 in response to the actual power level. While operating within the predetermined warm-up time of step 210, microprocessor M1 will return to step 110 to repeat voltage and current readings, and offset the index number at step 150 to shift switching sequences and tune the power to the igniter to the desired level. When the predetermined igniter warm-up time is reached, the microprocessor M1 will proceed to send a signal through pin RB7 or RB1 as to whether the igniter has been powered to a level proven to ignite gas. If the power to the igniter 40 is at a level proven to ignite gas for an application, the offset number used to compensate the index number is stored in step 220 in EEPROM (electrically erasable programmable read only memory) to immediately shift the index number at step 150 on the next start up. If at step 220 the power to the igniter 40 is not at a level proven to ignite gas for an application, the microprocessor M1 will send a signal to an integrated furnace control or device, so as to prevent switching on of the gas supply to the igniter 40.

Figure 3:
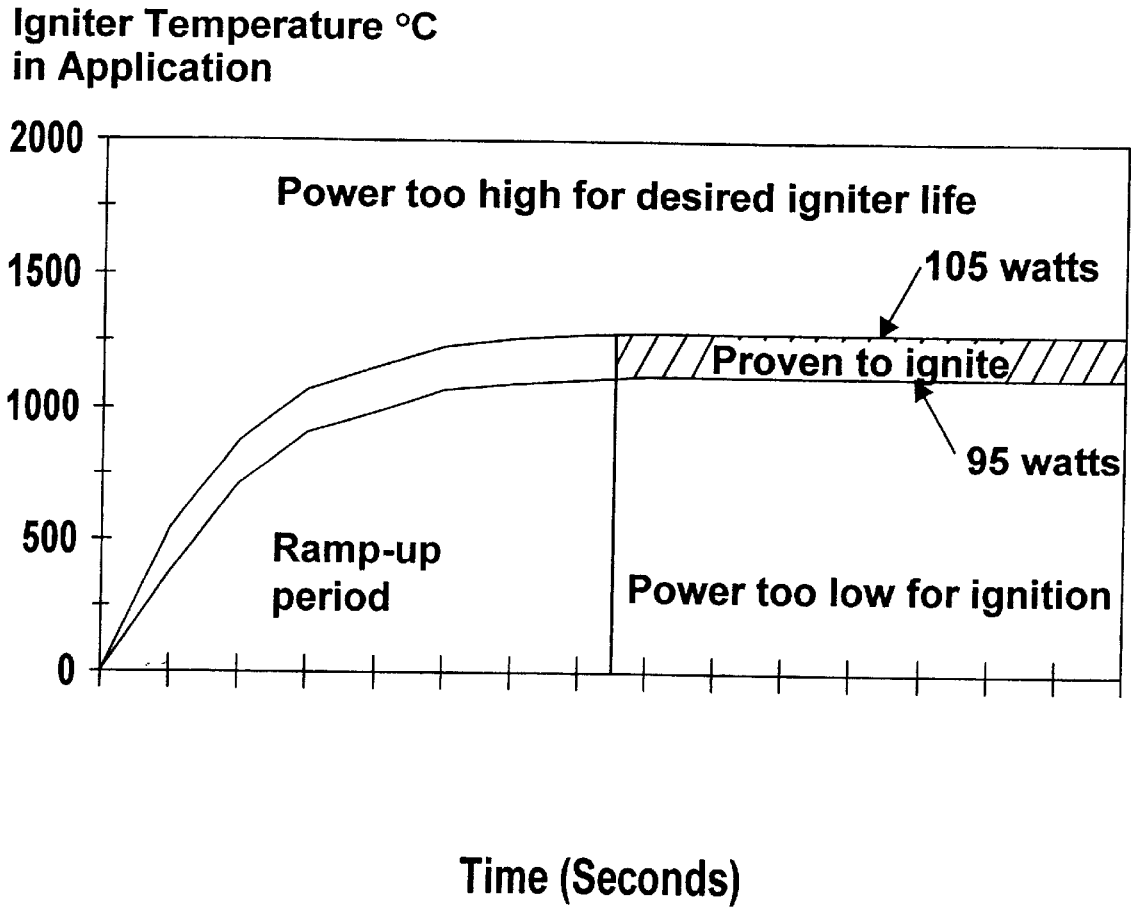
FIG. 3 is a graph of the temperature curve of an igniter powered by an igniter controlling system in accordance with the present invention.

Igniter 40 is constructed of a tungsten heater element embedded in a silicon nitride insulator material. The surface area of the silicon nitride insulator portion is relatively constant, even though the electrical resistance may vary from igniter to igniter. Specifically, FIG. 3 shows two temperature curves for a Kyocera Silicon Nitride igniter powered to 95 watts and 105 watts, which define a range below which the igniter is known to not ignite gas and above which the igniter is known to experience reduced life. This controlled range for powering such an igniter has been proven to ignite gas in the Genesis boiler application. Resistance variations are overcome by operating the igniter within a specific range of power, which dissipates from the relatively constant surface area to produce a consistent heat source proven to ignite gas in a given application. For example, a power range of 95 to 105 watts as shown in FIG. 3 is proven to ignite gas in a maximum airflow, minimum air temperature setting of an application such as a Genesis series Boiler manufactured by A. O. Smith Corporation. Other applications having greater airflow, such as a Legend series Boiler manufactured by A. O. Smith, may require a specified power range of 105 to 115 watts to reliably ignite gas. Therefore, it should be understood that the specified power range proven to ignite gas may vary depending on application. The specified power range also ensures the igniter will operate at a temperature below the 1300° C. critical temperature of the silicon nitride igniter 40, so as to prolong the life of the igniter.

With respect to the values of the component parts, (e.g., resistors transistors, and opto-isolators) as indicated in FIG. 1 and listed below, it should be noted that these values may be adjusted as required or desired depending upon the particular application and igniter assembly construction.

| 26 | OPTO-ISOLATOR MOC 3031 (manufactured by Fairchild) |
|---|---|
| R28 | 56K Ohm |
| R32 | 47K Ohm |
| R34 | 47K Ohm |
| R36 | 47K Ohm |
| R38 | 47K Ohm |
| R52 | ½ Ohm |
| R54 | ½ Ohm |
| R61 | 10K Ohm |
| R62 | 10K Ohm |
| R63 | 10K Ohm |
| R64 | 10K Ohm |
| R65 | 10K Ohm |

Those skilled in the art will recognize that the inventive igniter controlling system of this invention may be useful in many applications and for control of many different types of gas appliances. Inasmuch as many modifications within the spirit of the invention will be apparent to those skilled in the art, the scope of the invention should be determined by reference to the claims appended below and the full scope of equivalents as provided by applicable laws.

What is claimed is:

1. In a system for controlling power to an igniter for igniting gas, an improved means for controlling activation of an igniter comprising:

a switching means for connecting a power source to said igniter; and a control means for determining the voltage value of said power source, for determining the current value in said igniter, and for determining a switching sequence to supply a specified range of power to said igniter through said switching means by said power source.

2. The system according to claim 1 wherein said specified range of power is about 95 to 115 watts.

3. The system according to claim 1 wherein said switching means comprises a triac, and said control means includes a microprocessor.

4. The system according to claim 3 wherein said microprocessor determines said switching sequence based on said voltage value of said power source.

5. The system according to claim 4 wherein said microprocessor also includes a look-up table having offset values for adjusting said switching sequence, based on said voltage value of said power source, and said current value in said igniter.

6. The system according to claim 1 wherein the igniter comprises a tungsten heater element embedded in a silicon nitride insulating material.

7. In a system for controlling power to an igniter for igniting gas, an improved means for controlling activation of an igniter comprising:

a switching means for connecting a power source to said igniter; and a control means for periodically determining the voltage value of said power source, for periodically determining a switching sequence based on said voltage value, for operating said switching means based on said switching sequence, for periodically determining the current value in said igniter, and for periodically adjusting said switching sequence so as to provide a specified range of power to said igniter.

8. The system according to claim 7 wherein said control means for periodically adjusting said switching sequence includes a look-up table having offset values for adjusting said switching sequence, based on said voltage value of said power source and said current value in said igniter.

9. The system according to claim 8 wherein said igniter comprises a tungsten heater element embedded in a silicon nitride insulating material.

10. A method of controlling activation of an igniter, the method comprising the steps of:

periodically determining the voltage value of said power source to be applied to said igniter; and periodically determining a switching sequence based on said voltage value of said power source; and applying said power source to said igniter based on said switching sequence; and periodically determining the current value in said igniter; and periodically adjusting said switching sequence, based on said voltage value of said power source and said current value in said igniter, so as to provide a specified range of power to said igniter.

11. The method according to claim 10 wherein the step of adjusting said switching sequence includes the step of:

selecting an offset value in a look-up table in the ROM of a microprocessor that corresponds to said voltage value of said power source and the current value in said igniter; and applying power based on said switching sequence adjusted by said offset value so as to provide a specified range of power to said igniter.

* * * * *